United States Patent [19]
Simcoe et al.
[11] 4,262,882
[45] Apr. 21, 1981

[54] FENCE STRUCTURE HAVING IMPROVED CORNER CONSTRUCTION

[75] Inventors: Lee A. Simcoe; Mathew C. Miller, both of Tucson, Ariz.

[73] Assignee: American Fence Co., Inc., Phoenix, Ariz.

[21] Appl. No.: 97,136

[22] Filed: Nov. 26, 1979

[51] Int. Cl.[3] ..... E04H 17/16
[52] U.S. Cl. ..... 256/22; 256/24; 256/65
[58] Field of Search ..... 256/24, 25, 22, 21, 256/65, 59, 27

[56] References Cited

U.S. PATENT DOCUMENTS

| | | | |
|---|---|---|---|
| 2,863,642 | 12/1958 | Pagett | 256/22 |
| 3,195,937 | 7/1965 | Case | 256/65 X |
| 4,063,714 | 12/1977 | Kirkwood | 256/24 |
| 4,074,893 | 2/1978 | Coltrin | 256/21 |
| 4,078,772 | 3/1978 | Carbone | 256/65 X |

*Primary Examiner*—Andrew V. Kundrat
*Attorney, Agent, or Firm*—Cahill, Sutton & Thomas

[57] ABSTRACT

A fence structure includes vertically oriented wooden panels supported by vertical metal posts and horizontal metal rails and maintains an attractive appearance at the corners of the fence structure by permitting the wooden panels positioned at the corners to be in intimate contact with and directly fastened to a metal post located at each corner. The vertically oriented wooden panels are fastened to upper and lower horizontal metal rails. The upper and lower rails are butt-welded to vertical metal posts located at the corners of the fence structure and lap-welded to vertical metal posts located between corners of the fence structure. Each of the wooden panels located at the corners of the fence structure contacts the corner post along substantially its entire length, and fasteners positioned at several points along the length of the corner post secure the corner panels to the corner post for preventing the corner panels from becoming bowed outward.

5 Claims, 8 Drawing Figures

FENCE STRUCTURE HAVING IMPROVED CORNER CONSTRUCTION

BACKGROUND OF THE INVENTION

1. Field of the Invention:

The present invention relates generally to fence structures having panels supported by horizontal rails attached to vertical posts and, more particularly, to a fence structure having panels immediately contacting and directly fastened to posts located at each of the corners of the fence structure.

2. Description of the Prior Art:

Conventional wood panel fences are typically constructed by anchoring vertical wooden posts in the ground and fastening two or more horizontal wooden rails from post to post. Wooden panels or planks are then nailed to the horizontal wooden rails to complete the fence structure.

Over a period of time, however, the wooden posts frequently have a tendency to weaken due to weathering, rot and pests. If a gate is incorporated into the fence structure, stress upon the posts to which the gate is mounted causes additional weakening of the posts. Also, the horizontal wooden rails have a tendency to warp and sag over a period of time. Expansion and contraction of the wood also results in loosening of the nails used to attach the wooden panels to the horizontal wooden rails.

To overcome the disadvantages of conventional wooden panel fences, fence structures have been proposed which employ vertical metal posts and horizontal metal rails to support wooden planks. One such fence structure is disclosed in U.S. Pat. No. 2,863,642 wherein the posts and rails are composed of angle iron and bolted to one another while the wooden planks are attached to the horizontal rails with wire staples.

The fence structure disclosed in the above mentioned patent overcomes most of the disadvantages associated with conventional wood panel fences described above. However, the metal posts and rails are visible on one side of the fence, and this side of the fence has an unattractive appearance, due in part to the use of angle iron for the posts and rails and also due in part to the assorted bolts and staples used to attach the rails to the posts and to attach the wooden panels to the rails. Additionally, such a fence structure requires a significant amount of time for installation.

Another problem associated with the above mentioned fence structures relates to the formation of a gap between the wood panels adjacent the corners of the fence structure over a period of time. In order to maintain privacy of the area enclosed by the fence structure, the wooden panels located at a corner at which two walls of the fence structure intersect one another are typically positioned to initially overlap one another somewhat. However, the wooden panels located adjacent the corner will tend to warp over a period of time. Since these wooden panels are secured only where they contact the horizontal rails, these wooden panels will tend to become bowed outward due to the warpage. Eventually, the wooden panels adjacent the corner will no longer overlap one another resulting in a loss of privacy and a loss of a smooth appearance at the corner of the fence structure.

It is therefore an object of the present invention to provide a fence structure having rigidly supported wooden panels and having a pleasing appearance on either side of the fence structure.

It is further object of the present invention to provide a fence structure having rigidly supported wooden panels and which can be installed easily and quickly.

It is still another object of the present invention to provide a wood panelled fence structure having specially constructed corners for maintaining a neat appearance and for maintaining privacy of the area enclosed by the fence structure.

It is a further object of the present invention to provide a wood panelled fence structure adapted to prevent wooden panels attached to corners of the fence structure from becoming bowed outward due to warpage.

SUMMARY OF THE INVENTION

Briefly described, and in accordance with one embodiment thereof, the present invention provides a fence structure having vertical metal posts and horizontal metal rails for supporting fence panels, the fence structure having at each corner thereof a vertical metal post against which the ends of the horizontal metal rails abut for allowing fence panels located at the corners of the fence structure to intimately contact the corner metal post throughout its height and be directly fastened thereto. The vertical metal posts and horizontal metal rails are both of rectangular cross-section, and the vertical metal posts support the horizontal metal rails. Each of the horizontal metal rails has an outer face against which the fence panels are supported. Each of the horizontal metal rails also has an inner face opposite the outer face, and vertical metal posts located other than at corners of the fence structure are attached to the inner face of the horizontal metal rails. At corners of the fence structure, the ends of the horizontal metal rails are butted against and attached to the corner post for allowing fence panels located at the corners to be directly fastened to and immediately contacted by the corner post along substantially the entire length of the fence panel.

DETAILED DESCRIPTION OF THE PREFERRED EMBODIMENT

Figure 1:
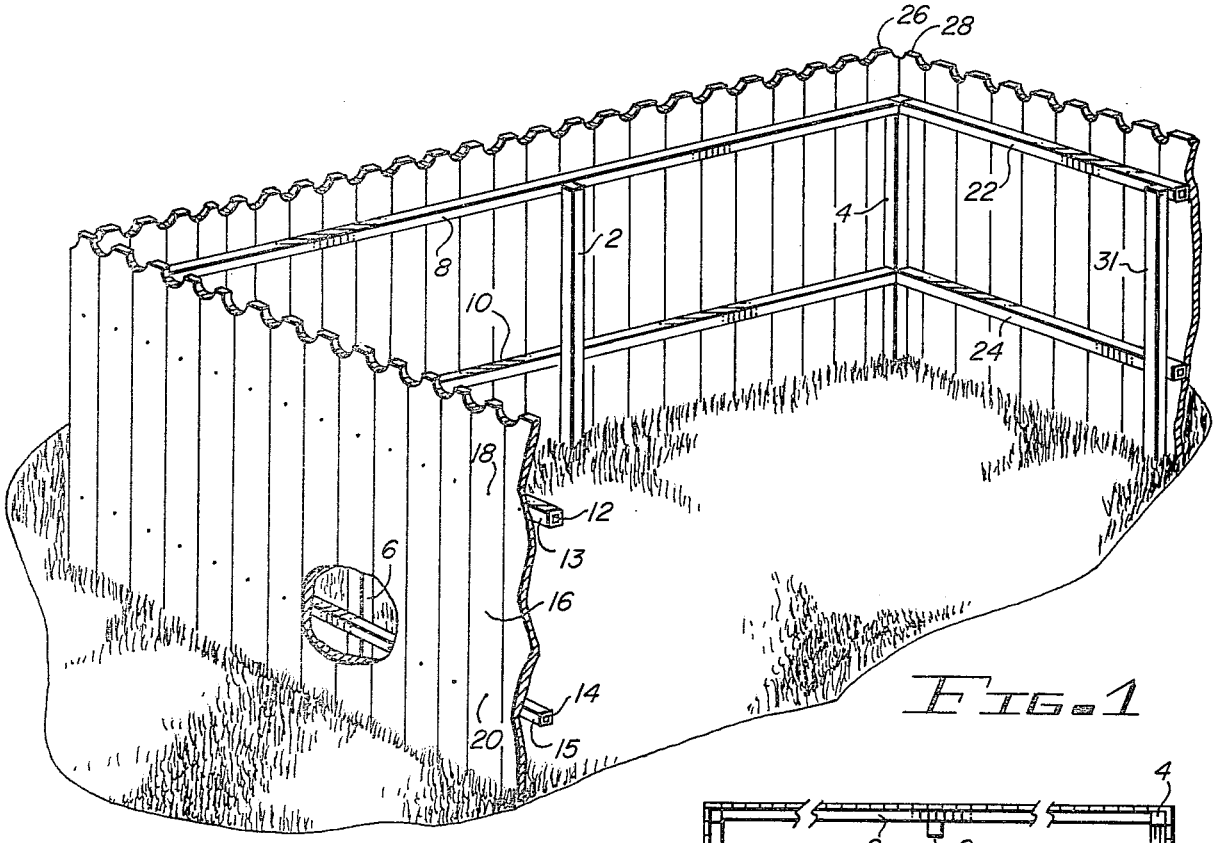
FIG. 1 is a perspective view of a fence structure according to one embodiment of the present invention.
Figure 4:
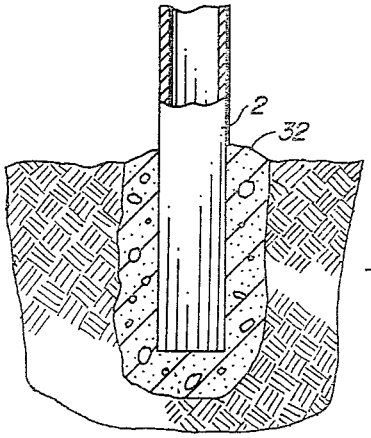
FIG. 4 is a cross-sectional view of a footing used to anchor a vertical metal post.

The fence structure shown in FIG. 1 includes a plurality of vertically mounted metal posts of which posts 2, 4 and 6 are representative. The vertical metal posts are typically composed of two inch square metal tubing of the type often used for fashioning ornamental wrought iron style fencing. Each vertical post preferably extends eighteen inches below the ground and is embedded in a concrete footing for rigidly anchoring the post as shown in FIG. 4. In FIG. 4, a cross-sectional view extending below ground level illustrates a footing for vertical metal post 2. Vertical metal post 2 extends approximately 18 inches below ground level and is embedded in a region of concrete 32 having a depth of approximately 2 feet.

The vertical posts may be spaced approximately on ten foot centers to provide sufficient support for the fence structure. The length of the portion of the post extending above the ground is selected to be several inches less than the height of the wooden fence panels used to construct the fence structure. A two inch square cap is typically welded to the upper end of each vertical post for preventing water or debris from collecting within the post.

Attached to vertical posts 2 and 4 are an upper horizontal metal rail 8 and a lower horizontal metal rail 10 for supporting a first wall of the fence structure. Metal rails 8 and 10 are typically composed of one and one-half inch square metal tubing of the type often used to fashion ornamental wrought iron style fencing. Metal rails 8 and 10 each include an outer face 9 (see FIG. 3) against which wooden panels may be fastened, as will be explained below. Horizontal rails 8 and 10 also include an inner face 11 (see FIG. 3) opposite the outer face. The inner faces of horizontal rails 8 and 10 are each lap-welded to vertical post 2.

Figure 5:
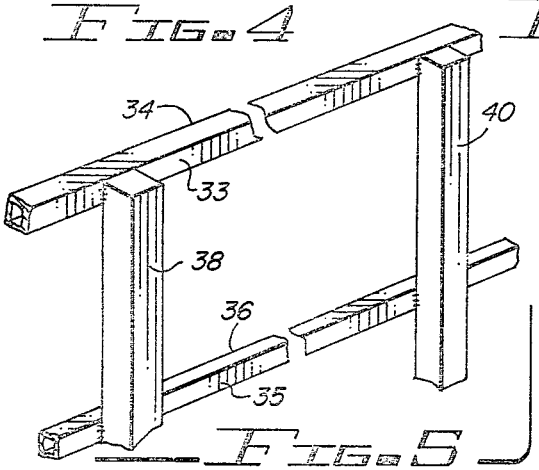
FIG. 5 is a partial perspective view of a straight portion of the fence structure prior to attachment of wooden panels.

Lap-welding horizontal rails 8 and 10 to vertical post 2 in the fence structure shown in FIG. 1 is desirable for several reasons. Lap-welding provides a strong support structure and avoids the necessity for attachment hardware which would detract from the appearance of the fence structure. Lap-welding can be accomplished easily and quickly, thereby speeding the construction of the fence structure. Also, lap-welding allows a single continuous horizontal rail to be supported by two or more consecutive posts along straight sections of the fence structure, as shown for example in FIG. 5. In FIG. 5, the inner faces 33 and 35 of horizontal rails 34 and 36, respectively, are lap-welded to both vertical posts 38 and 40, thereby allowing horizontal rails 34 and 36 to each extend continuously in either direction beyond posts 38 and 40.

Shown in a cutaway portion of FIG. 1 are horizontal metal rails 12 and 14 and vertical post 6 for supporting a second wall of the fence structure. A plurality of decorative fence panels of which panel 16 is representative, are fastened against the outer faces 13 and 15 of metal rails 12 and 14, respectively. The decorative fence panels may be composed of wood (e.g. redwood, cedar, etc.) or another decorative material. Wooden panel 16 is fastened to horizontal metal rails 12 and 14 at points designated 18 and 20 in FIG. 1. Fasteners particularly adapted for attaching the wooden panels to the horizontal metal rails will be described below.

Figure 6:
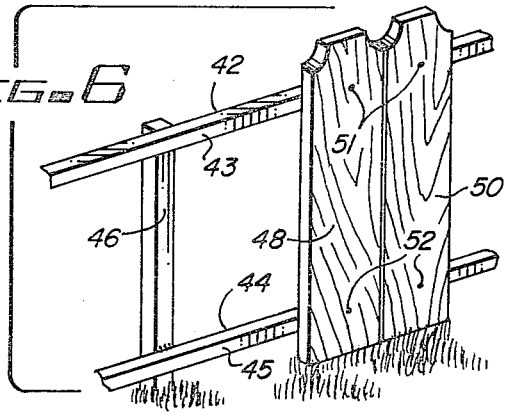
FIG. 6 is a partial perspective of the fence structure having two wooden panels fastened thereto.

FIG. 6 illustrates the attachment of the wooden panels to the horizontal rails in greater detail. Horizontal rails 42 and 44 are lap-welded to vertical post 46. Wooden panels 48 and 50 are fastened to the outer faces 43 and 45 of horizontal rails 42 and 44, respectively, at points designated 51 and 52, respectively.

Figure 2:
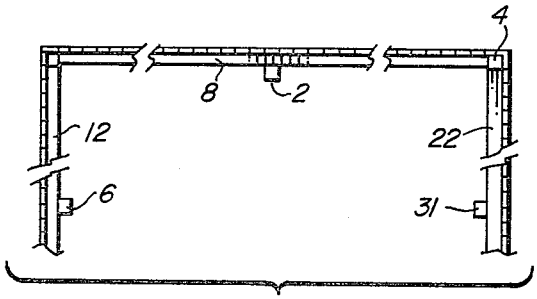
FIG. 2 is a top view of the fence structure illustrated in FIG. 1.
Figure 3:
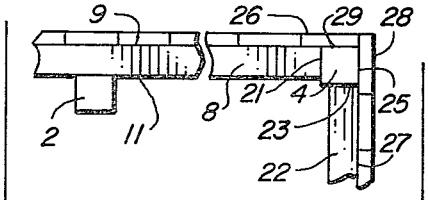
FIG. 3 is a more detailed top view of a portion of the fence structure illustrated in FIG. 1.

Referring now to FIGS. 1, 2 and 3, horizontal metal rails 22 and 24 are shown supporting a third wall of the fence structure, the third wall intersecting the first wall at corner post 4. Corner post 4 supports horizontal rails 8 and 10 and also supports horizontal rails 22 and 24. Horizontal rails 22 and 24 may be further supported by vertical post 31 as shown in FIG. 2. The inner faces of horizontal rails 22 and 24 are lap-welded to vertical post 31 in a manner identical to that used to lap-weld horizontal rails 8 and 10 to vertical post 2. One end of each of the horizontal rails 8 and 10 is butted against and attached to a first face 21 of corner post 4. Such attachment is typically accomplished by butt-welding the ends of horizontal rails 8 and 10 to corner post 4. Similarly, one end of each of the horizontal rails 22 and 24 is butted against and attached to a second face 23 of corner post 4, the second face 23 being perpendicular to the first face 21. A third face 25 of corner post 4 is parallel to the first face, and each of horizontal rails 22 and 24 has its outer face 27 coplanar with the third face of corner post 4. Similarly, corner post 4 includes a fourth face 29 parallel to its second face 23, and each of horizontal rails 8 and 10 has its outer face 9 coplanar with the fourth face 29 of vertical post 4.

As may be seen in FIG. 1 and in the more detailed top view shown in FIG. 3, wooden panels 26 and 28 form the corner of the fence structure adjacent corner post 4. Since the fourth face 29 of corner post 4 is coplanar with the outer faces 9 of horizontal rails 8 and 10, wooden panel 26 is simultaneously supported by the outer faces 9 of horizontal rails 8 and 10 as well as the fourth face 29 of corner post 4. Since the fourth face 29 of corner post 4 is in intimate contact with wooden panel 26 substantially along its entire length, wooden panel 26 may be directly fastened to corner post 4 at several points, including points located between horizontal rails 8 and 10. When wooden panel 26 is directly fastened to corner post 4 in this manner, wooden panel 26 cannot become warped or bowed outward as would otherwise be the case.

Similarly, wooden panel 28 is in intimate contact with the third face 25 of vertical post 4 substantially along its entire length. Thus, wooden panel 28 can also be fastened directly to corner post 4 at several points for preventing wooden panel 28 from becoming warped or bowed outward.

Those skilled in the art will realize that if horizontal rails 8, 10, 22 and 24 had been lap-welded to corner post 4 rather than butt-welded, wooden panels 26 and 28 could not have been directly fastened to corner post 4; wooden panel 26 would have been supported soley by horizontal rails 8 and 10, while wooden panel 28 would have been supported solely by horizontal rails 22 and 24. In this case, wooden panels 26 and 28 would likely become warped and bowed outward over a period of time. The bowing outward of wooden panels 26 and 28 would have resulted in a gap at the corner of the fence structure, thereby detracting from the appearance of the fence structure and reducing the privacy which it provides.

Butt-welding the horizontal rails to the corner posts seals the ends of the horizontal rails against the corner post. Were the horizontal rails lap-welded to the corner post, it would be necessary to weld metal caps onto the ends of the horizontal rails to prevent moisture and debris from collecting within the horizontal rails.

Figure 7:
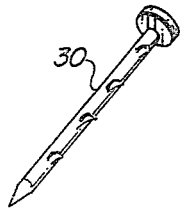
FIG. 7 illustrates a barbed nail which may be used in constructing the fence structure.

FIG. 7 illustrates a barbed nail which may advantageously be used to fasten the wooden panels to the metal posts and rails. Barbed nail 30 has a hardened tip which can pierce a wooden panel and the outer face of a metal post or rail when barbed nail 30 is propelled by a suitable powered driving tool. The barbs formed on the shaft of barbed nail 30 securely grip the metal post or rail into which barbed nail 30 is driven. Barbed nail 30 is galvanized to prevent corrosion at the point at which it contacts the metal post or rail and to prevent staining of the wooden panels. The wooden panels can be installed quickly and securely through the use of the barbed nails in conjunction with the powered driving tool.

Figure 8:
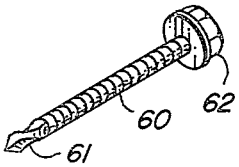
FIG. 8 illustrates a self-tapping screw which also may be used in constructing the fence structure.

An alternative means for fastening the wooden panels to the metal support structure is a self-tapping screw shown in FIG. 8. The self-tapping screw 60 has at one end a tip 61 configured much like a drill bit for allowing the screw to drill through the wooden panel and into the supporting metal post or rail when the screw is turned. At the end of the screw opposite the tip is a hex-shaped head 62 for turning the screw. A motor driven screwdriver having a socket for engaging the hex-shaped head may be used for installing the self-tapping screws. As in the case of the barbed nails mentioned above, the self-tapping screws are galvanized. The use of the self-tapping screws in conjunction with the motor driven screwdriver allows the wooden panels to be installed quickly and securely.

It will now be appreciated that a fence structure having rigidly supported fence panels has been described which maintains an attractive appearance and preserves the privacy of the area enclosed. Viewed from outside the enclosed area, the fence structure has the appearance of a traditional wooden fence. Viewed from within the enclosed area, the fence structure combines the natural appearance of wood with the beauty of ornamental wrought iron style fencing. Additionally, the manner of constructing the described fence structure permits rapid installation. While the invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

What is claimed is:

1. A fence structure including at least a first and second fence wall intersecting one another at a corner, comprising:

a. a first metal post having a rectangular cross-section and extending vertically along the corner, said first metal post having first, second, third, and fourth vertically oriented faces, the first and second faces being perpendicular to one another, the first and third faces being parallel to one another, and the second and fourth faces being parallel to one another;

b. a first plurality of metal rails each having a rectangular cross-section and each extending horizontally for supporting the first wall, each of said first plurality of metal rails having an end butt-welded to the first face of said first metal post, each of said first plurality of metal rails having an outer face coplanar with the fourth face of said metal post and an inner face opposing the outer face;

c. a second plurality of metal rails each having a rectangular cross-section and each extending horizontally for supporting the second wall, each of said second plurality of metal rails having an end butt-welded to the second face of said first metal post, each of said second plurality of metal rails having an outer face coplanar with the third face of said metal post;

d. a second metal post having a rectangular cross-section and extending vertically adjacent the inner face of each of said first plurality of metal rails, said second metal post being lap-welded to the inner face of each of said first plurality of metal rails for supporting the first wall;

e. a third metal post having a rectangular cross-section and extending vertically adjacent the inner face of each of said second plurality of metal rails, said third metal post being lap-welded to the inner face of each of said second plurality of metal rails for supporting the second wall;

f. a first and a second plurality of panels, at least one of said first plurality of panels intimately contacting the fourth face of said metal post, and at least one of said second plurality of panels intimately contacting the third face of said metal post; and g. attaching means for attaching said first plurality of panels to the outer faces of said first plurality of metal rails to form the first wall and for attaching said second plurality of panels to the outer faces of said second plurality of metal rails to form the second wall.

2. A fence structure as recited in claim 1 wherein said attaching means attaches said panel intimately contacting the fourth face of said first metal post directly to said first metal post and attaches said panel intimately contacting the third face of said first metal post directly to said first metal post.

3. A fence structure as recited in claim 1 wherein said first and second plurality of panels are composed of wood.

4. A fence structure including at least a first and a second fence wall intersecting one another at a corner, comprising:

a. a first metal post having a rectangular cross-section and extending vertically along the corner, said first metal post having first, second, third, and fourth vertically oriented faces, the first and second faces being perpendicular to one another, the first and third faces being parallel to one another, and the second and fourth faces being parallel to one another;

b. a first plurality of metal rails each having a rectangular cross-section and each extending horizontally for supporting the first wall, each of said first plurality of metal rails having an end butted against and attached to the first face of said first metal post, each of said first plurality of metal rails having an outer face coplanar with the fourth face of said metal post and an inner face opposing the outer face;

c. a second plurality of metal rails each having a rectangular cross-section and each extending horizontally for supporting the second wall, each of said second plurality of metal rails having an end butted against and attached to the second face of said first metal post, each of said second plurality of metal rails having an outer face coplanar with the third face of said metal post;

d. a second metal post having a rectangular cross-section and extending vertically adjacent the inner face of each of said first plurality of metal rails, said second metal post being attached to the inner face of each of said first plurality of metal rails for supporting the first wall;

e. a third metal post having a rectangular cross-section and extending vertically adjacent the inner face of each of said second plurality of metal rails, said third metal post being attached to the inner face of each of second plurality of metal rails for supporting the second wall;

f. a first and a second plurality of panels, at least one of said first plurality of panels intimately contacting the fourth face of said metal post, and at least one of said second plurality of panels intimately contacting the third face of said metal post; and g. a plurality of galvanized nails for attaching said first plurality of panels to the outer faces of said first plurality of metal rails to form the first wall and for attaching said second plurality of panels to the outer faces of said second plurality of metal rails to form the second wall, each of said galvanized nails having a shaft portion for extending through one of said panels and into one of said metal rails or into said first metal post, the shaft portion having barbs formed thereon for securely gripping said metal rails or said first metal post.

5. A fence structure including at least a first and a second fence wall intersecting one another at a corner, comprising:

a. a first metal post having a rectangular cross-section and extending vertically along the corner, said first metal post having first, second, third, and fourth vertically oriented faces, the first and second faces being perpendicular to one another, the first and third faces being parallel to one another, and the second and fourth faces being parallel to one another;

b. a first plurality of metal rails each having a rectangular cross-section and each extending horizontally for supporting the first wall, each of said first plurality of metal rails having an end butted against and attached to the first face of said first metal post, each of said first plurality of metal rails having an outer face coplanar with the fourth face of said metal post and an inner face opposing the outer face;

c. a second plurality of metal rails each having a rectangular cross-section and each extending horizontally for supporting the second wall, each of said second plurality of metal rails having an end butted against and attached to the second face of said first metal post, each of said second plurality of metal rails having an outer face coplanar with the third face of said metal post;

d. a second metal post having a rectangular cross-section and extending vertically adjacent the inner face of each of said first plurality of metal rails, said second metal post being attached to the inner face of each of said first plurality of metal rails for supporting the first wall;

e. a third metal post having a rectangular cross-section and extending vertically adjacent the inner face of each of said second plurality of metal rails, said third metal post being attached to the inner face of each of said second plurality of metal rails for supporting the second wall;

f. a first and a second plurality of panels, at least one of said first plurality of panels intimately contacting the fourth face of said metal post, and at least one of said second plurality of panels intimately contacting the third face of said metal post; and g. a plurality of galvanized screws for attaching said first plurality of panels to the outer faces of said first plurality of metal rails to form the first wall and for attaching said second plurality of panels to the outer faces of said second plurality of metal rails to form the second wall, each of said plurality of galvanized screws having a shaft portion for extending through one of said panels and into one of said metal rails or into said first metal post, the shaft portion having at one end thereof a tip for drilling a hole in one of said metal rails or in said first metal post when the shaft portion is turned, the shaft portion having threads thereon for threadedly engaging one of said metal rails or said metal post.

* * * * *